US005735536A

United States Patent [19]

Myers et al.

[11] Patent Number: 5,735,536

[45] Date of Patent: Apr. 7, 1998

[54] SKATE AND SKATE CHASSIS AND METHOD OF MAKING AND USING THE SAME

[75] Inventors: Robert Myers; Richard Maertz, both of Anaheim, Calif.

[73] Assignee: Motiv Sports, Inc., Anaheim, Calif.

[21] Appl. No.: 548,331

[22] Filed: Nov. 1, 1995

Related U.S. Application Data

[63] Continuation of Ser. No. 501,627, Jul. 12, 1995, abandoned.

[51] Int. Cl.[6] ..... A63C 1/26; A63C 17/06; A63C 17/18

[52] U.S. Cl. ..... 280/7.13; 280/11.22; 280/11.27

[58] Field of Search ..... 280/7.12, 7.13, 280/7.14, 11.12, 11.19, 11.22, 11.23, 11.27, 11.18, 11.16, 11.3, 841

[56] References Cited

U.S. PATENT DOCUMENTS

| | | | |
|---|---|---|---|
| 310,923 | 1/1885 | Wardwell | 280/7.13 |
| 1,266,386 | 5/1918 | Barr | 280/7.13 |
| 1,319,094 | 10/1919 | Kerrigan | 280/7.13 |
| 2,868,553 | 1/1959 | Rieckman | 280/11.27 |
| 3,086,787 | 4/1963 | Wyche | 280/11.19 |
| 4,058,324 | 11/1977 | Dallaire | 280/11.22 |
| 4,108,450 | 8/1978 | Cote | 280/7.13 |
| 4,932,695 | 6/1990 | Olson | 280/7.13 |
| 5,385,356 | 1/1995 | Conte | 280/11.27 |
| 5,484,149 | 1/1996 | Lee | 280/11.22 |
| 5,507,506 | 4/1996 | Shadroui | 280/11.27 |
| 5,533,740 | 7/1996 | Lin | 280/11.22 |

FOREIGN PATENT DOCUMENTS

| | | | |
|---|---|---|---|
| 2566672 | 1/1986 | France | 280/11.22 |
| 8701675 | 2/1989 | Netherlands | 280/7.13 |

*Primary Examiner*—Anne Marie Boehler
*Attorney, Agent, or Firm*—Loeb & Loeb LLP

[57] ABSTRACT

A skate assembly has a skate chassis, a boot and a motive member such as rollers or an ice blade. The skate chassis having an elongated body, a heel member and a toe member. The body having concave portions which reduce torsional flex on the chassis. Raised ribs and channels of the body and the members are engaged so as to allow the members to slide longitudinally along the body. The boot can be mounted on the heel and the toe members, and the motive member can be attached to the chassis, thus forming a skate assembly. The toe member having a curving plate for preserving the shape of the boot. Moreover, the heel and toe members can be positioned at numerous distances from one another on the body, thus supporting different boot sizes and providing different positions for the boot on the body.

23 Claims, 5 Drawing Sheets

SKATE AND SKATE CHASSIS AND METHOD OF MAKING AND USING THE SAME

This is a continuation of application Ser. No. 08/501,627 filed on Jul. 12, 1995, abandoned.

BACKGROUND OF THE INVENTION

1. Field of the Invention

The present invention relates to skate assemblies, components thereof, and methods of making and using the same and, in particular embodiments, to an in-line roller skate or an ice skate, with an adjustable chassis in relation to heel and toe members fixed to a boot.

2. Related Art

Skating (ice and roller) has become a popular recreational and professional activity in many countries. A typical skate assembly has a boot (defined as any suitable structure for receiving a skaters foot) supported on a skate chassis, and a motive member (such as a set of rollers or an ice blade) coupled to the chassis. Modern skaters place high demands on their skating equipment. Some skaters require high performance and precision skate designs. Others desire versatility, low maintenance and low cost. This has led to a variety of prior skate configurations designed to address at least some of these demands.

For performance and precision skating, the location of the skate, boot relative to the chassis and motive member can be important. For example, a boot mounted toward the front of the chassis will typically allow the skater to lean forward with better balance and control. However, a boot mounted toward the rear of the chassis will allow the skater to more easily skate backwards, such as is typically done by defensive hockey players or by skaters performing skating tricks. Typical skates have been constructed with the boot permanently mounted to the chassis, in a predetermined, fixed position relative the chassis. For example, skates designed for hockey (or other skating activities requiring the skater to have good balance and control while leaning forward) are typically constructed with the boot permanently mounted in a forward position on the chassis. On the other hand, skates designed for stunts, tricks or speed skating are typically constructed with the boot permanently mounted in a rearward position on the chassis. Some skaters desiring versatility in boot positions may have to purchase multiple pairs of such skates each with a different boot position.

The type and condition of the motive member is also an important factor in the performance of the skate. Some motive members are designed for ice (e.g., ice blades), while others (e.g., roller wheels) are designed for higher friction surfaces (e.g., pavement). Even within these categories, some motive members are designed for speed, while others are designed for precision and control. Furthermore, motive members tend to wear or break over time, which can significantly affect the performance characteristics of the skate.

For versatility in performance, some skates have been designed with replaceable and interchangeable motive members. For example, U.S. Pat. No. 4,492,385 to Olson describes a skate having a shoe riveted to an elongated body, wherein an elongated bean carrying an ice blade slides into engagement with the body and is replaceable with a similar beam carrying a set of roller wheels. While the Olson '385 skate design allows the skater to replace and interchange (and to some extent adjust the position of) the motive member relative to the body, the design requires a body that is particularly dimensioned to the size of the shoe, so that the heel and toe coupling plates (24 and 22 in Olson's FIG. 1) of the body align with the heel and toe of the shoe. As a result, different body dimensions for each shoe size may be necessary, which can significantly increase the manufacturing difficulty and cost of the skate.

Another skate design with an interchangeable motive member feature is described in U.S. Pat. No. 4,932,675 to Olson et al. The Olson et al. '675 skate design also requires a body (26 in Olson et al.'s FIG. 1) dimensioned to the specific size of the shoe and locks the shoe to the body in a fixed, non-adjustable position.

Thus, there is a need in the industry for a versatile, adjustable skate design, that can be manufactured by economical manufacturing processes, that can be mounted to a wide range of boot sizes while using the adjustable function described herein, and that can provide the performance, durability and economy demanded by modern skaters.

SUMMARY OF THE DISCLOSURE

A preferred embodiment of the present invention is directed to a economically designed, performance skate assembly that includes a chassis which can accommodate multiple boot sizes and multiple chassis body positions along the length of the boot, as well as providing a comfortable support for the skate boot.

A skate assembly according to an embodiment of the present invention comprises three general components, namely: a skate chassis, a boot, and a motive member. The boot is mounted to toe and heel members of the chassis, for receiving a skater's foot. The motive member, which may comprise, for example, a set of in-line roller wheels or an ice skate blade, is also mounted to the chassis.

The chassis comprises, in general, a body, a toe member, and a heel member. The chassis includes a unique interlocking channel system (ICS), wherein the body is provided with either channels or raised ribs which engage either raised ribs or channels provided on the heel and toe members, to allow the body, heel and toe members to slide relative to each other, to locate the heel and toe members at various positions along the length of the body.

Because the heel and toe members are separate elements, these members can be positioned at various distances from one another, thus allowing placement for accommodating different boot sizes. In addition, the ability of the body to slide through the too and heel members allows a given boot to be positioned at any one of multiple boot positions along the length of the body, thus, providing the flexibility for a skater to position the boot, e.g. closer to or further from the front end of the body, based on the skater's skill level, size or desired skating position. Once the chassis body is moved to a desired position relative to the boot, the body is secured to the heel and toe members in the desired or selected positions, by heel and toe member locking means. The engaged channel and rib arrangement ensures a precise alignment for the heel and toe members on the body, and minimizes movement of the heel and toe members relative to the body, once the heel and toe members are secured in selected heel and toe positions along the length of the body.

In preferred embodiments, the heel and toe members each have an integral mounting plate for mounting to the sole of a skate boot. The elevation between the mounting plate and the rib or grooves of the heel member is greater than that of the toe member. In this manner, the ribs or grooves on the toe end of the body may be aligned with (and may also be coextensive with) the ribs or grooves on the heel end of the body. This allows the body to take a shape having a substantially constant cross-section along its length, thus readily lending itself to extrusion manufacturing processes.

According to further preferred embodiments of the present invention, the body is provided with further structural designs to substantially minimize torsional flex that can otherwise cause skate roller wheels to bind. The torsional flex is reduced by extending the central portion of the body outwardly so as to create a lengthwise bulge or bow along the length of the body. The lengthwise bulge or bow tends to increase the structural strength of the body in a manner which reduces the tendency of the body to flex torsionally.

Further preferred embodiments of the present invention provide a comfortable, high performance position between the boot and the toe member, by providing a curved surface on the toe member for mounting to the matching curved surface of the toe end of the boot sole. The toe portion of the boot is thereby provided with a positive contact to the toe member over the entire curved surface of the toe member.

BRIEF DESCRIPTION OF THE DRAWINGS

These and other features, aspects, and advantages of the present invention will become better understood from the following description, appended claims, and accompanying drawings where:

DETAILED DESCRIPTION OF PREFERRED EMBODIMENTS

Figure 1:
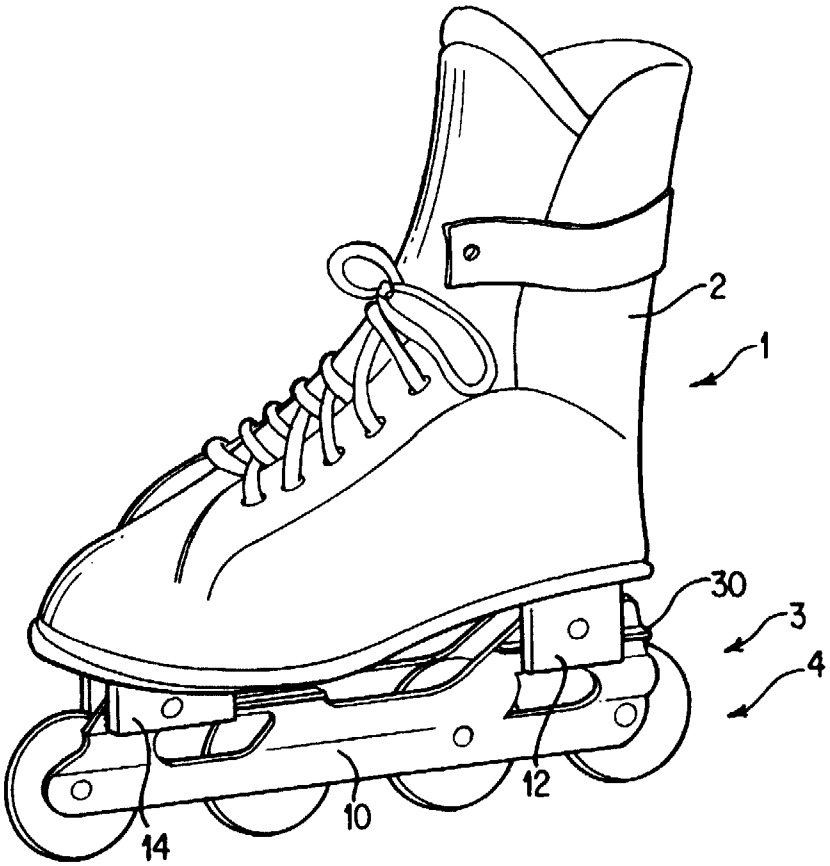
FIG. 1 is a perspective view of a skate assembly according to an embodiment of the present invention.

Referring now to the drawing, FIGS. 1–9 illustrate a skate assembly 1 and components thereof according to a first embodiment of the present invention.

Figure 10A:
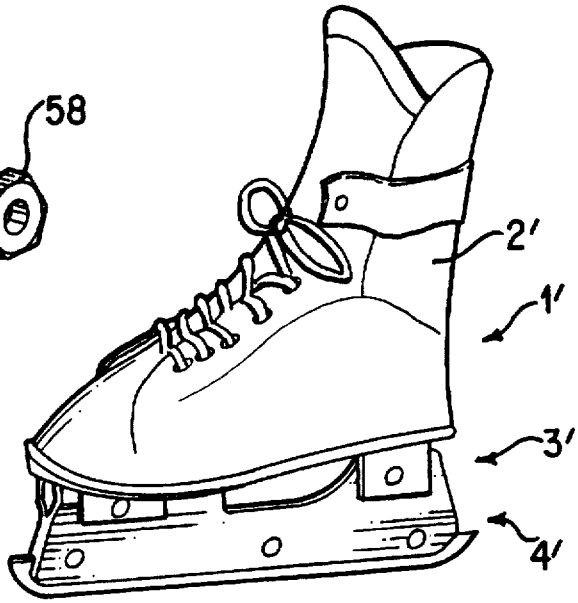
FIGS. 10*a* and 10*b* are side and cross-section views of a skate assembly according to a further preferred embodiment of the present invention.
Figure 10B:
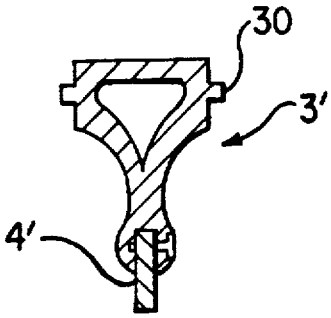

The skate assembly 1, as shown in FIG. 1, is an in-line roller skate assembly having a boot 2, a chassis 3 and a motive member 4 (composed of a plurality of rollers arranged in a line). In further embodiments, the motive member 4 is composed of other suitable motion enabling means, such as an ice skate blade or pairs of rollers sharing a common axle. FIGS. 10*a* and 10*b* show a skate assembly 1', provided with a boot 2', a chassis 3' and a motive member 4' composed of an ice-skate blade arrangement. Further skate embodiments are configured to accept chassis bodies with rollers and chassis bodies with an ice blade within a common set of heel and toe members, such that a skater may readily replace a set of roller wheels with an ice blade (or vice versa) without replacing the toe and heel members or the boot.

As will be apparent from the following description and the drawings, preferred embodiments of the skate chassis (3 or 3') are configured to provide certain distinct advantages, including adjustability to accommodate various boot sizes, adjustability to accommodate various boot positions relative to the chassis and capability of being manufactured by extrusion manufacturing techniques. As discussed in more detail below, various aspects of the shape and construction of preferred chassis configuration embodiments provide these distinct advantages, as well as other advantages, such as maximization of structural strength, minimization of torsional flex, minimization of weight and minimization of manufacturing and maintenance costs.

For purposes of clarity and simplification, the following description is primarily directed to the embodiment shown in FIGS. 1–9. However, it will be recognized that various features and components described with respect to the FIG. 1 embodiment are applicable to further embodiments, including the embodiment of FIGS. 10*a* and 10*b*.

Figure 5A:
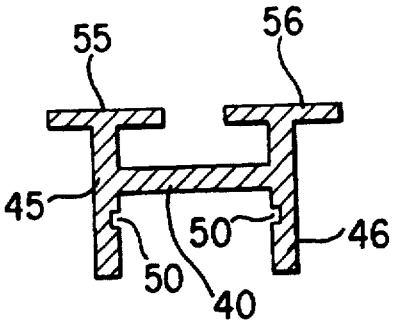
FIG. 5*a* is a cross-section view of the heel member of FIG. 4, taken along lines 5—5 of FIG. 4.
Figure 5B:
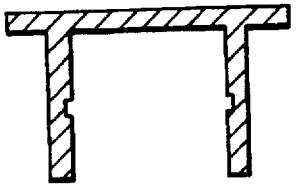
FIG. 5*b* is a cross-section view of another heel member embodiment.
Figure 6:
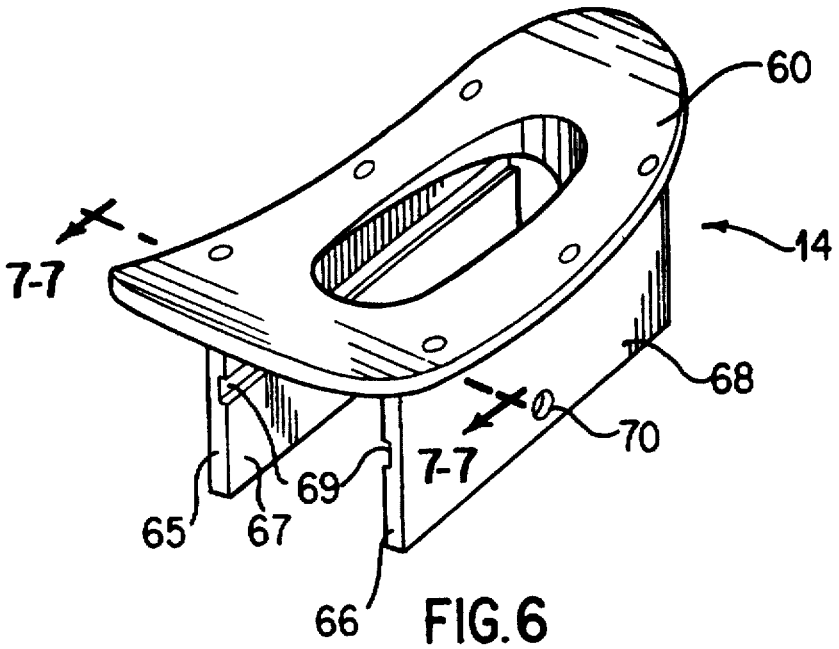
FIG. 6 is a perspective view of a toe member for a skate chassis according to an embodiment of the present invention.
Figure 7:
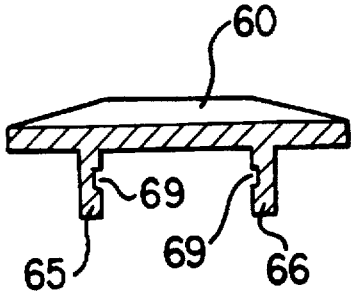
FIG. 7 is a cross-section view of the toe member of FIG. 6, taken along lines 7—7 of FIG. 6.

With reference to FIG. 1, the toe end and the heel end of the sole of boot 2 is secured to the top side of the heel member (FIG. 4) and toe member (FIG. 6). The motive member 4 is also secured to the chassis 3 and extend from the bottom side of the chassis. The chassis 3, itself, is composed of a body 10 (FIGS. 2 and 3), a heel member 12 (FIGS. 4 and 5) and a toe member 14 (FIGS. 6 and 7). The heel and toe members 12 and 14 couple to the heel and toe ends of the sole of boot 2, respectively.

As discussed in further detail below, chassis body 10 is dimensioned to slide into and engage the heel and toe members 12 and 14, even when the heel and toe members are secured to the boot 2. In general, the chassis has an unique interlocking channel system (ICS), wherein the body is provided with a pair of ribs which engage a corresponding pair of grooves in each of the heel and toe members, such that the body and the heel and toe members are each coupled for sliding motion along at least a portion of the length of the body. (Further embodiments employ grooves on the body and ribs on the heel and toe members for similar engagement and sliding action.) A locking mechanism is provided for each of the heel and toe members to selectively lock each of the heel and toe members at any one of a plurality of positions along the body. The engaged ribs and grooves maintain a precise alignment of the heel and toe members, while allowing the relative distance between the heel and toe members to be selectable (and adjustable) and further allowing the locations of the heel and toe members on the body to be selectable (and adjustable). These features are discussed in further detail below, with respect to the ribs 30 and grooves 50 on the body 10, heel member 12 and toe member 14.

Figure 2:
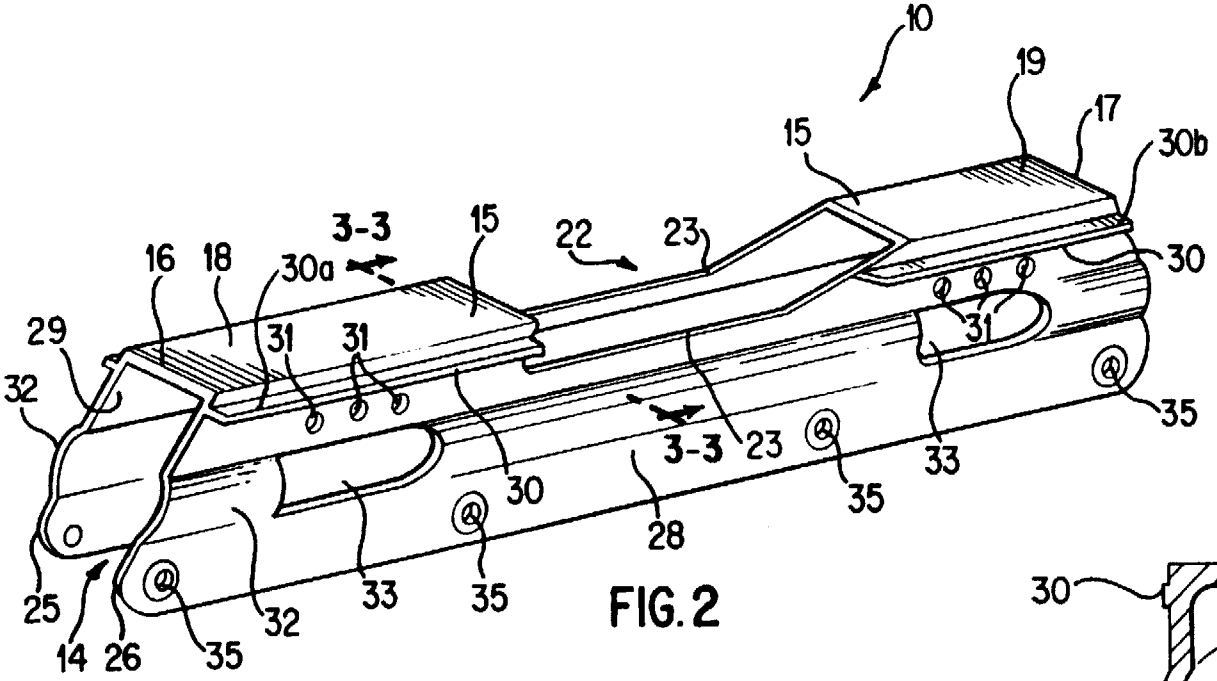
FIG. 2 is a perspective view of a body for a skate chassis according to an embodiment of the present invention.
Figure 3:
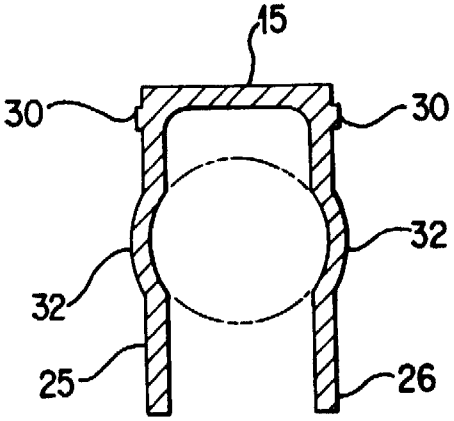
FIG. 3 is a cross-section view of the body of FIG. 2, taken along line 3—3 of FIG. 2.

Referring now to FIGS. 2 and 3, body 10 has an upper wall 15, a front end 16, a rear end 17 and two spaced apart symmetrical side walls 25 and 26 extending downward from the upper wall 15. The body 10 further has a hollow interior 14 extending longitudinally between the two side walls 25 and 26 for mounting and housing a portion of the motive member 4. In preferred embodiments the hollow interior 14 provides a convenient housing for mounting the motive member 4 and (by virtue of being hollow), tends to reduce the overall weight of the skate as well as the cost of materials.

The upper wall 15 of the body 10 has a toe support surface 18 adjacent the front end 16, and a heel support surface 19 adjacent the rear end 17 of the body. In preferred embodiments, an opening 22 is provided in the upper surface 15, between the toe support surface 18 and the heel support surface 19. As shown in FIG. 2, the opening 22 defines openings or recess areas 23 extending downward in the side walls 25 and 26. The opening 22 reduces the overall weight of the body 10, without significantly affecting the structural strength of the body. The openings 22 also simulate the profile of an ice blade.

The side walls 25 and 26 each have an exterior surface 28 and an interior surface 29. The upper extent of each side wall 25 and 26 has a raised rib 30 extending longitudinally along the exterior surface 28, adjacent the top wall 15. In preferred embodiments, the raised ribs 30 are discontinued in the recess areas 23, to define rib portions 30*a* and 30*b* adjacent the toe support surface 18 and heel support surface 19, respectively. In further preferred embodiments (not shown), the raised ribs 30 may be provided below the recess areas (or the recess areas 23 may be omitted) such that each rib 30 is continuous along the length of the body 10.

In either case, it is preferred that each rib 30 is generally straight and extend in a direction parallel to the toe and heel surfaces 18 and 19, to define a cross-section shape, taken perpendicular to the length dimension of the body (as shown in FIG. 3), which remains constant along the length dimension of the body, except at body locations where body material is missing, such as in the locations of openings 22 and 33 and holes 31 and 35 (where the cross-section shape differs only in that portions of the body material are omitted). If the ribs 30 are discontinued in the recess areas 23, then it is preferred that the rib portions 30*a* and 30*b* are aligned with each other and that each rib portion is straight and extends in a direction parallel to the surfaces 18 and 19, also to define a constant cross-section shape along the length of the body (except for locations on the length of the body in which body material is omitted).

Extrusion processes can be highly efficient and cost effective manufacturing techniques for articles that are shaped suitable for extrusion, such as a shape defining a constant cross-section (or a cross-section which is constant but for locations at which material is removed by post-extrusion processes). Thus, the constant cross-section shape of body 10 is suitable for extrusion manufacturing processes, wherein body is manufactured by passing body material through a dye opening having the shape of the body cross-section (e.g., as shown in FIG. 3). Post extrusion processing steps to remove body material to form openings 22 and 33 and holes 31 and 35 (discussed below) may be provided by relatively simple machining operations. In this regard, preferred body configuration embodiments are designed to be manufacturable by extrusion processes. Preferred embodiments of processes of manufacture include a step of extruding a body member from, for example, a light-weight, durable, suitably strong material, such as aluminum, aluminum alloy, metal matrix, or other suitable materials. However, further embodiments may be formed by other suitable manufacturing processes, including, but not limited to molding, casting, stamping and the like.

Each side wall 25 and 26 of the body 10 has a plurality of adjusting holes 31 disposed adjacent the raised rib 30. The adjusting holes 31 in side wall 25 are aligned with the adjusting holes 31 in side wall 26. In preferred embodiments, a first plurality of adjusting holes 31 are disposed below the toe member support surface 18 and a second plurality of adjusting holes 31 are disposed below the heel member support surface 19 in each side wall, to provide a relatively high degree of adjustability, as discussed below. In the illustrated embodiment, three adjusting holes 31 are provided below the surface 18 and three further adjusting holes 31 are provided below surface 19 in each side wall. However, in further embodiments, any suitable numbers of adjusting holes are provided below the surfaces 18 and 19. Preferably, either the number of adjusting holes below surface 18 or the number of adjusting holes below surface 19 is greater than one, so as to allow for adjustment of the location along body 10 of either one or both of the heel member 12 and the toe member 14, as described below.

Also in preferred embodiments, a central portion of each side wall 25 and 26 extends outwardly to define a convex, bulged or bowed portion 32 along the length of the body 10. The convex, bulged or outward bowed portions 32 function to increase the torsional strength of the body, to resist torsional flexing of the body that can otherwise bind wheels mounted within the body. The enhanced structural strength provided by, for example, the bowed portions 32, can allow the body to maintain a suitable structural integrity, even with openings (such as openings, 22 and 33) formed in the body for purposes of weight reduction.

At least one opening 33 (and preferably plural openings) may be provided through the outward bowed portion 32 of each side wall 25 and 26, for purposes of reducing the overall weight of the body. In addition, a plurality of motive member attaching holes 35 are provided in the lower extent of the body side walls 25 and 26. The attaching holes 35 in side wall 25 are aligned with corresponding attaching holes 35 in side wall 26. In the illustrated embodiment of FIG. 2, four attaching holes 35 are provided in each side wall 25 and 26 for securing a motive member (composed of four roller wheels in FIG. 1) to the body. However, in other embodiments, any suitable number of attaching holes may be provided and/or other suitable means of attaching a motive member to the body may be employed.

In the illustrated embodiment, the attaching holes 35 are not threaded. Instead, the motive member (e.g., set of wheels) is attached to the body by means requiring no threads in the attaching holes. It is also preferred that the motive member is attached to the body by means which allow the motive member to be readily detached from and/or installed onto a body by simple steps, so that a skater can, for example, readily replace a worn or broken motive member or interchange one style of motive member for another with minimum effort.

Figure 8:
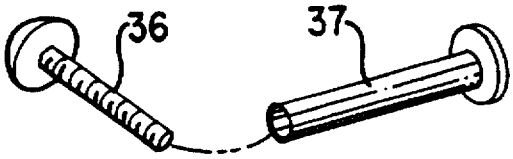
FIG. 8 is a perspective view of an attaching means according to an embodiment of the present invention, for attaching a motive member to the body and for attaching the chassis body to heel/toe members.

One example of such means, as shown in FIG. 8, is composed of a threaded bolt 36 and a correspondingly threaded bolt receptacle member 37. The bolt has an elongated threaded shaft and a head, and the bolt receptacle has an elongated threaded tube and a head. The diameters of the elongated shaft and the elongated threaded tube are smaller than the diameter of the attaching holes 35 (for passing through the attaching holes) and the diameters of the heads are greater than the diameter of the attaching holes 35. In this manner, with the heads located adjacent the exterior surfaces 28 of the side walls 25 and 26, the elongated portions of the threaded members 36 and 37 may be passed through opposed holes 35 in side walls, through a portion of a motive member (such as the central aperture of a roller wheel), and threaded together to couple the motive member (roller wheel) to the body 10. The heads of the threaded members 36 and 37 may be provided with suitable indentation patterns (not shown), for example, for receiving the head of a standard or philips style screw-driver or an allen wrench, for assisting in motive member (roller wheel) removal, installation or tightening operations. In the illustrated embodiment, four sets of threaded bolts and bolt receptacles mount a motive member 4 to the body 10. Thus, replacement or interchanging of motive members requires a relatively simple operation of only four threaded connectors.

Figure 4:
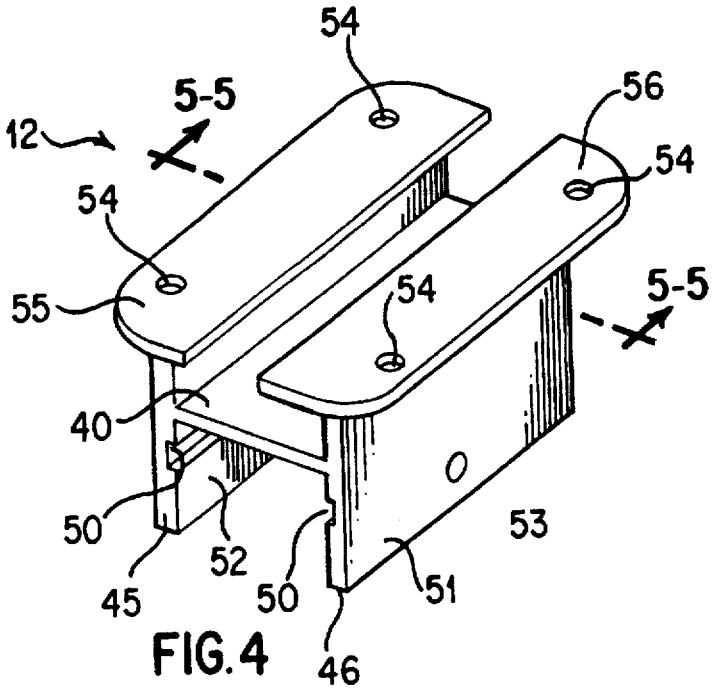
FIG. 4 is a perspective view of a heel member for a skate chassis according to an embodiment of the present invention.

Referring now to FIGS. 4 and 5*a*, a heel member 12 is configured to engage and slide along the length of the body (or at least along the length of the heel support surface 19). The heel member 12 has a central support member 40 coupling two symmetrical, spaced apart side wall members 45 and 46. At the upper ends of the side wall members 45 and 46, mounting plates 55 and 56, respectively, are provided for coupling the heel member to the heel end of a boot sole. In FIGS. 4 and 5, the mounting plates 55 and 56 are separated by a gap therebetween. However, in further embodiments (not shown), the gap may be eliminated, in effect providing a single plate extending over both side wall members 45 and 46 (instead of two plates 55 and 56 separated by a gap) for coupling the heel member to the sole of the boot.

However, the two plate embodiment is preferred because of the reduction in weight resulting from the omission of material in the space between the plates. In addition, the cross-section shape of the two plate embodiment (as shown in FIG. 5*a*) is more suitable for manufacturing by an extrusion process (wherein a suitable material, such as aluminum, aluminum alloy, metal matrix, or the like, is passed through a dye aperture shaped in accordance with the cross-section shape of the heel member). On the other hand, in a single plate embodiment, the central support member 40 may be omitted (as the side wall members 45 and 46 would be coupled together by the single plate) to provide a suitable shape for extrusion, such as shown in FIG>5*b*.

Figure 9:
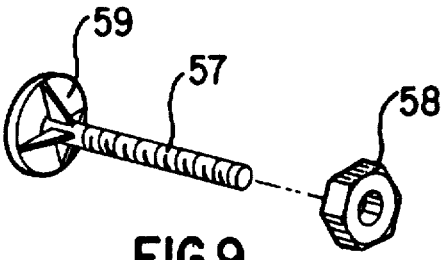
FIG. 9 is a perspective view of an attaching means according to an embodiment of the present invention, for attaching a heel or toe member to a boot.

Attaching holes 54 are provided in the plates 55 and 56 (or in the single plate of the single plate embodiment discussed above) for passing threaded connectors (such as screws, bolts, or the like) or unthreaded connectors (such as rivets, or the like) through the plates and into the boot sole to couple the heel member to the sole of the boot. In preferred embodiments, the attaching members comprise a threaded connector having a threaded bolt 57 provided with a finned head and a threaded nut 58 (preferably a nylon lock nut), as shown in FIG. 9. The finned head bolt is provided with a threaded shaft extending from a head and fins 59 on the shaft side of the head. The shaft is of a suitable length to extend through holes provided in the sole of the boot and through a hole 54 in one of the plates 55 and 56 (with the head located inside the boot), the head having a diameter larger than the diameter of the holes in the boot sole. The nut 58 engages the threaded shaft portion that passes through the hole in plate 55 or 56 and has a diameter larger than the hole in plate 55 or 56.

As the nut and bolt are threaded together, the fins 59 on the shaft side of the bolt head are drawn into the soft material forming the inner sole of the boot. This provides a suitable friction-locking engagement of the bolt to the boot, so as to inhibit rotation of the bolt relative to the boot. As a result, the nut 58 may be rotated about the bolt shaft, while the bolt is inhibited from rotation by virtue of the fin-to-boot engagement. Once the fin-to-boot engagement has occurred, the nut may be readily threaded off of or onto the bolt shaft for removing or replacing the heel member from the boot, while the bolt remains fixed to the boot sole.

Each side wall member 45 and 46 of the heel member has an exterior surface 51 and an interior surface 52. A groove or channel 50 is provided in the interior surface 52 of each side wall member 45 and 46. The dimensions of the channels 50 correspond to those of the ribs 30 (or at least rib portions 30*b*), such that at least a portion of each rib 30 (or rib portion 30*b*) may be received within a channel 50. The lengths of the channels 50 extend along the length of the heel member and parallel with the plane of the central member 40. At least one locking hole 53 is provided through each side wall member 45 and 46, below the channels 50.

The distance between the facing interior surfaces 52 of the side wall members 45 and 46 is slightly larger than the distance between the exterior surfaces of the body side walls 25 and 26. In addition, the distance between the channels 50 and the lower surface of the central member 40 is slightly larger than the distance between the ribs 30 and the heel support surface 19 of the body. The heel member 12, therefore, is configured to fit over the body 10, with the inner surfaces 52 adjacent and facing the upper extent of the exterior surfaces of the body side walls 25 and 26, the channels 50 receiving the ribs 30, and with the lower surface of the central member 40 facing the heel support surface 19, in a close-fitting, but sliding engagement.

In preferred embodiments, a locking mechanism is provided to selectively lock the heel member to the body at any one of multiple user-selectable positions along the length of the body. In particular, the heel member and body are engaged for sliding motion in the length direction of the body, as discussed above. Once, the desired heel member position is reached, a suitable locking mechanism locks the heel member to the body, in the selected position along the length of the body. Any suitable locking mechanism may be used for locking the heel member to the body, including, but not limited to threaded connectors (such as screws, bolts or the like) or unthreaded connectors (such as removable pins, quick release-spring-loaded pins, snap-fitting protrusions and indentations on facing surfaces of the heel member and body, or the like). It is preferred that the locking mechanism be a type which is easily unlocked when desired, for simplifying adjustment operations.

In preferred embodiments, the locking mechanism comprises a single threaded connector adapted to extend through the locking holes 53 in the heel member side walls and the holes 31 in the body. According to such embodiments, the heel member 12 is engaged for sliding motion along the body, as discussed above, and is moved to one of multiple available positions in which the locking holes 53 align with a pair of holes 31 in the two side walls 25 and 26 of the body. Once the holes are aligned, a threaded connector is passed through the holes, to lock the heel member in a fixed position relative to the body. Preferably, neither the locking holes 53 nor the body holes 31 are threaded and a threaded connector as shown and described above with respect to FIG. 9 is employed to lock the heel member to the body. This avoids the need to form threads in the body and heel member, the avoidance of which can lead to reduced manufacturing costs and minimization of maintenance and repair costs (e.g., which might otherwise occur if threaded holes on a body or heel member are stripped or otherwise damaged).

For comfortable skating positions, it is preferred that the boot heel be supported at a greater height than the boot toe. The height of the heel of the boot is determined by the distance between the channels 50 and the mounting surfaces of the plates 55 and 56. Thus, heel members may be readily manufactured to provide any suitable heel height, without altering the configuration or dimensions of the body 10.

Referring now to FIGS. 6 and 7, a toe member 14 is configured to engage and slide along the length of the body (or at least along the length of the toe support surface 19). The toe member 14 has a pair of symmetrical, spaced apart side wall members 65 and 66 and a plate 60 for mounting to the toe portion of a boot sole. The side wall members 65 and 66 extend downward from the plate 60 in FIGS. 6 and 7 and each define an interior surface 67 and an exterior surface 68. A channel 69 is provided in the interior surface 67 of each side wall member 65 and 66. The dimensions of the channels 69 correspond to those of the ribs 30 (or at least the rib portions 30*a*), such that at least a portion of each rib 30 (or rib portion 30*a*) may be received within a channel 69. The lengths of the channels 50 extend along the length of the toe member 14. At least one hole 70 is provided through each side wall member 55 and 66, below the channels 69.

The distance between facing interior surfaces 67 of the side wall members 65 and 66 is slightly larger than the spacing between the exterior surfaces of the body side walls 25 and 26. In addition, the distance between the channels 69 and the lower surface of the plate 60 is slightly larger than the distance between the ribs 30 and the toe support surface 18 of the body. The toe member 14, therefore, is configured to fit over the body 10, with the interior surfaces 67 adjacent and facing the upper extent of the exterior surfaces of the body side walls 25 and 26, the channels 69 receiving the ribs 30 and with the lower surface of the plate 60 facing the toe support surface 18, in a close-fitting, but sliding engagement.

In preferred embodiments, a locking mechanism is provided to selectively lock the toe member to the body at any one of multiple user-selectable positions along the length of the body. In particular, the toe member and body are engaged for sliding motion relative to each other in the direction of the length of the body, as discussed above. Once, the desired toe member position is reached, a suitable locking mechanism locks the toe member and the body together, in the selected toe member position along the length of the body. Any suitable locking mechanism may be used for locking the toe member to the body, including, but not limited to the locking mechanisms discussed above with respect to locking the heel member to the body.

For example, the locking mechanism comprises a threaded connector adapted to extend through the locking holes 70 in the toe member side walls and the holes 31 in the body. According to such embodiments, the toe member 14 and body 10 are engaged for relative sliding motion, as discussed above, and are moved relative to each other to one of multiple available positions in which the locking holes 70 align with a pair of holes 31 in the two side walls 25 and 26 of the body. Once the holes are aligned, a threaded connector is passed through the holes, to lock the toe member in a fixed position relative to the body. Preferably, neither the locking holes 70 nor the body holes 31 are threaded and a threaded connector as shown and described above with respect to FIG. 9 is employed to lock the toe member to the body. This avoids the need to form threads in the body and toe member, the avoidance of which can lead to reduced manufacturing costs and minimization of maintenance and repair costs (e.g., which might otherwise occur if threaded holes on a body or toe member are stripped or otherwise damaged).

Attaching holes are provided in the plate 60 for passing threaded connectors (such as screws, bolts, or the like) or unthreaded connectors (such as rivets, or the like) through the plates and into the boot sole to couple the toe member to the sole of the boot. In preferred embodiments, the attaching members comprise a threaded connector of the type shown and described above with respect to FIG. 9.

In preferred embodiments, the plate 60 is curved (defines a concave curvature in the lengthwise direction of the toe member) to match the curvature of the bottom of the boot 2 at the toe end of the boot. This allows the toe plate 60 to be coupled to the boot sole, directly below the toe portion of the boot, while providing a positive contact between the sole of the boot and the toe member 14, along the entire length of the plate 60. The positive contact at the toe end of the boot provided by the curvature of the plate 60 tends to improve the controllability and responsiveness of the skate.

In operation, a skater mounts the heel and toe members 12 and 14, respectively to a boot 2 with a plurality of threaded connectors 57 and 58. In addition, a motive member (e.g., a set of roller wheels) is mounted to a body 10 with four threaded connectors 36, 37. Then the heel and toe members are engaged with the body 10 and the body is moved (by sliding motion) relative to the heel and toe members to a desired skating position. In the desired position, the heel and toe members are locked to the body, each with a single threaded connector 36, 37.

Preferably, the ribs 30 are continuous along the body side walls 25 and 26 (or the rib portions 30*a* and 30*b* are aligned with each other) such that the steps of engaging the heel and toe members with the body and sliding the body relative to the heel and toe members comprises the step of engaging one end of the body with one of the heel and toe members and sliding the end of the body through the engaged heel or toe member until the body end reaches the other of the heel and toe member. Then continuing to slide the body through the other of the heel and toe member until a proper skating position is reached. The continuous ribs 30 (or at least the aligned rib portions 30*a* and 30*b*) allow the body to slide relative to the heel and toe members, from one end of the body to the other, such that the heel and toe members can be engaged with the body at a common end and moved (relative to the body) in a common direction, to reach the desired skating position. This step can be readily carded out by a skater, for example, while wearing a boot with the heel and toe members mounted thereto.

From the forgoing, it is apparent that the disclosed embodiments provide several distinct advantages. For example, the combination of separate heel and toe members 12 and 14 and the ability of each of these members to engage the chassis body, independent of the other member, along the body 10, provides significant adjustment benefits. For different boot sizes, the spacing between the heel and toe members 12 and 14 will likely differ. However, because the heel and toe members are each moveable (by sliding motion) along the body, independent of each other, prior to mounting to the boot, the heel and toe members may be spaced relatively close together on the body for small boots and may be spaced at a greater distance from each other on the same body for larger boots. Thus, the same size body, heel and toe members may accommodate a number of different boots sizes. As a result, the cost of manufacturing the body, heel and toe members for a variety of different boot sizes is minimized. That is, it is not necessary to manufacture a different size body, heel member or toe member for each different size boot. Most popular boot sizes can be accommodated by a single body size or, for example, as few as three body sizes (lengths 290 mm, 260 mm and 230 mm).

Also, as discussed above, the combination of the ability of the body 10 to slide along the heel and toe members 12 and 14, and the multiple, selectable locking positions available for these members, allows the skating position to be adjusted. For example, the position of the boot relative to the body may be selected and adjusted such that the boot may be positioned toward the front end 16 of the body 10 or toward the rear end 17 of the body (or any number of positions therebetween), depending upon the skater's desired skating position. Furthermore, the sliding arrangement allows a skater to readily and quickly replace a chassis body (and connected motive member) without removing the boot from the skater's foot, merely by removing the locking mechanisms locking the heel and toe members to the body, sliding the body from the heel and toe members and engaging another body with the heel and toe members.

In addition to the above-discussed adjustment and replacement features, the construction of the preferred body, heel and toe members are designed for relatively economical manufacturing processes, such as extrusion processes. Moreover, the constructions of these members are designed for high strength and torsion resistance for improved performance.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A skate chassis for supporting a motive member and a boot, the skate chassis comprising:

an elongated body having a first end, a second end, sidewalls with outer surfaces, and a motive end, the outer surfaces of the elongated body sidewalls having raised ribs, the motive end having securing means for securing the motive member;

a toe member for supporting the boot, the toe member having sidewalls with inner surfaces and outer surfaces, the inner surfaces of the toe member sidewalls each having a channel, wherein the inner surfaces of the toe member sidewalls each include an upper generally planar surface portion above the channel and a lower generally planar surface portion below the channel, the toe member sidewalls further having means for attaching to the elongated body;

a heel member for supporting the boot, the heel member having sidewalls with inner surfaces and outer surfaces, the inner surfaces of the heel member sidewalls each having a channel, wherein the inner surfaces of the heel member sidewalls each include an upper generally planar surface portion above the channel and a lower generally planar surface portion below the channel the heel member sidewalls further having means for attaching to the elongated body; and wherein the channels of the toe member sidewalls engage the raised ribs of the elongated body sidewalls so as to allow the toe member to slide longitudinally along the elongated body, further the channels of the heel member sidewalls engage the raised ribs of the elongated body sidewalls so as to allow the heel member to slide longitudinally along the elongated body.

2. A skate assembly comprising a skate chassis of claim 1, wherein said motive member comprises a plurality of rollers, and wherein the skate chassis further having a hollow portion between the elongated body sidewalls for inserting the rollers therein, the securing means of the elongated body securing the rollers between the elongated body sidewalls.

3. A skate assembly comprising a skate chassis of claim 1, wherein said motive member comprises an ice blade, and wherein the securing means of the elongated body securing the ice blade.

4. A skate assembly of claim 2, wherein the skate assembly further comprising a boot, the boot being supported by the heel member and the toe member.

5. A skate assembly of claim 3, wherein the skate assembly further comprising a boot, the boot being supported by the heel member and the toe member.

6. A skate chassis of claim 1, wherein each elongated body sidewall further including sets of attaching holes at each end of the elongated body for attaching the heel and the toe members at numerous distances from one another, the attaching holes being disposed below the raised ribs.

7. A skate chassis of claim 1, wherein the elongated body has a top side with left edge and right edge, sidewalls of the elongated body each extending downwardly from the left edge and the right edge of the top side respectively.

8. A skate chassis for supporting a boot and a sliding member, the skate chassis comprising:

a toe member comprising a plate and two spaced apart ears with inner surfaces and outer surfaces, the plate having a plurality of holes for supporting the boot, the ears extending downwardly from the plate, each ear having a hole and inner surfaces of the ears each having a channel, wherein the inner surfaces of the ears each include an upper generally planar surface portion above the channel and a lower generally planar surface portion below the channel;

a heel member comprising a central member having a right side and a left side, the heel member further comprising two spaced apart side members with inner surfaces and outer surfaces extending upwardly and downwardly from the right side and the left side of the central member defining upward and downward portions, each downward portion having a hole, and inner surfaces of the side members each having a channel, wherein the inner surfaces of the side members each include an upper generally planar surface portion above the channel and a lower generally planar surface portion below the channel, the heel member further comprising a plate being mounted on the upward portions of the side members, the plate running substantially in parallel with the central member, the plate having a plurality of holes for supporting the boot; and an elongated body having a top side, and two spaced apart sidewalls with outer surfaces extending downwardly from the top side, the outer surfaces of the sidewalls having raised ribs, each sidewall including sets of attaching holes at each end of the elongated body for attaching the heel and the toe members at numerous distances from one another, the attaching holes being disposed below the top side, the sidewalls further including a plurality of locking holes for locking the sliding member between the sidewalls, the locking holes being disposed below the attaching holes.

9. A skate assembly comprising a skate chassis of claim 8, wherein said sliding member comprises a plurality of rollers, and wherein the skate chassis further having a hollow portion between the two sidewalls for inserting the rollers therein, the rollers being locked between the locking holes of the two sidewalls.

10. A skate assembly comprising a skate chassis of claim 8, wherein said sliding member comprises an ice blade, and wherein the ice blade being locked between the locking holes of the two sidewalls.

11. A skate assembly of claim 9, wherein the skate assembly further comprising a boot, the boot having a toe and a heel, the boot being attached to the toe member at the toe and to the heel member at the heel.

12. A skate assembly of claim 10, wherein the skate assembly further comprising a boot, the boot having a toe and a heel, the boot being attached to the toe member at the toe and to the heel member at the heel.

13. A skate chassis for supporting a boot and a sliding member, the skate chassis comprising:

a toe member comprising a plate and two spaced apart ears with inner surfaces and outer surfaces, the plate having a plurality of holes for supporting the boot, the ears extending downwardly from the plate, each ear having a hole and inner surfaces of the ears each having a channel, wherein the inner surfaces of the ears each include an upper generally planar surface portion above the channel and a lower generally planar surface portion below the channel;

a heel member comprising a central member having a right side and a left side, the heel member further comprising two spaced apart side members .with inner surfaces and outer surfaces extending upwardly and downwardly from the right side and the left side of the central member defining upward and downward portions, each downward portion having a hole, and inner surfaces of the side members each having a channel, wherein the inner surfaces of the side members each include an upper generally planar surface portion above the channel and a lower generally planar surface portion below the channel, the heel member further comprising a plate being mounted on the upward portions of the side members, the plate running substantially in parallel with the central member, the plate having a plurality of holes for supporting the boot; and an elongated body having a top side, and two spaced apart sidewalls extending downwardly from the top side, the sidewalls having exterior and interior sides, exterior sides of the sidewalls having raised fibs, each sidewall including an attaching hole at each end of the body disposed below the top side for attaching the heel member and the toe member to the body, the sidewalls extending outwardly below the attaching holes defining concave portions in the interior sides, the sidewalls further including a plurality of locking holes for locking the sliding member between the sidewalls, the locking holes being disposed below the concave portions.

14. A skate assembly comprising a skate chassis of claim 13, wherein said sliding member comprises an ice blade, and wherein the ice blade being locked between the locking holes of the two sidewalls.

15. A skate assembly of claim 14, wherein the skate assembly further comprising a boot, the boot having a toe and a heel, the boot being attached to the toe member at the toe and to the heel member at the heel.

16. A skate assembly of claim 13, wherein the skate assembly further comprising a boot, the boot having a toe and a heel, the boot being attached to the toe member at the toe and to the heel member at the heel.

17. A skate chassis of claim 13, wherein said plate is a curved plate having a front side and a rear side, the curved plate rising gradually at an angle from the rear side to the front side, the curved plate further having a plurality of holes for supporting the boot, the ears extending downwardly from the curving plate, each ear having a hole.

18. A skate chassis for supporting a motive member and a boot, the skate chassis comprising, an elongated body;

a toe member for supporting the boot, the toe member having second sidewalls, the second sidewalls having channels, the second sidewalls further having means for attaching to the elongated body;

a heel member for supporting the boot, the heel member having third sidewalls, the third sidewalls having channels, the third sidewalls further having means for attaching to the elongated body:

wherein the elongated body has a first end, a second end, first sidewalls, and a motive end, the first sidewalls having raised ribs, the motive end having securing means for securing the motive member, each first sidewall including sets of attaching holes at each end of the elongated body for attaching the heel and the toe members at numerous distances from one another, the attaching holes being disposed below the raised ribs, the first sidewalls extending outwardly below the attaching holes defining concave portions in interior sides of the first sidewalls; and wherein the channels of the second sidewalls engage the raised ribs of the first sidewalls so as to allow the toe member to slide longitudinally along the body, further the channels of the third sidewalls engage the raised ribs of the first sidewalls so as to allow the heel member to slide longitudinally along the body.

19. A skate chassis of claim 18 wherein the plate of the toe member further having a front side and a rear side, the plate rising gradually at an angle from the rear side to the front side.

20. A skate chassis of claim 19, herein the heel member is disposed at a higher level than the toe member.

21. A skate assembly comprising a skate chassis of claim 20, wherein said motive member comprises a plurality of rollers, and wherein the skate chassis further having a hollow portion between the first sidewalls for inserting the rollers therein, the rollers being locked between the locking holes of the first sidewalls.

22. A skate assembly of claim 21, wherein the skate assembly further comprising a boot, the boot having a toe and a heel, the boot being attached to the toe member at the toe and to the heel member at the heel.

23. A skate assembly of claim 22, wherein the skate assembly further comprising a boot, the boot having a toe and a heel, the boot being attached to the toe member at the toe and to the heel member at the heel.

* * * * *